US007578660B2

(12) United States Patent
Shimizu et al.

(10) Patent No.: US 7,578,660 B2
(45) Date of Patent: Aug. 25, 2009

(54) HERMETIC COMPRESSOR

(75) Inventors: Takashi Shimizu, Sakai (JP); Yoshitaka Shibamoto, Sakai (JP); Yoshinari Asano, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 383 days.

(21) Appl. No.: 10/559,188

(22) PCT Filed: Jun. 2, 2004

(86) PCT No.: PCT/JP2004/008017

§ 371 (c)(1),
(2), (4) Date: Dec. 1, 2005

(87) PCT Pub. No.: WO2004/111461

PCT Pub. Date: Dec. 23, 2004

(65) Prior Publication Data

US 2006/0120894 A1 Jun. 8, 2006

(30) Foreign Application Priority Data

Jun. 2, 2003 (JP) ..... 2003-156696

(51) Int. Cl.
*F04B 17/00* (2006.01)
*F04B 35/04* (2006.01)

(52) U.S. Cl. ..... 417/410.3; 418/63; 418/66

(58) Field of Classification Search ..... 417/410.1, 417/410.3, 363, 902; 418/63–67, 270
See application file for complete search history.

(56) References Cited

U.S. PATENT DOCUMENTS

| | | | | |
|---|---|---|---|---|
| 4,577,472 | A * | 3/1986 | Pandeya et al. | 62/324.6 |
| 4,601,644 | A * | 7/1986 | Gannaway | 417/363 |
| 6,942,464 | B2 * | 9/2005 | Brashears et al. | 417/234 |
| 2004/0052659 | A1 * | 3/2004 | Kim | 417/363 |
| 2004/0109779 | A1 * | 6/2004 | Yang et al. | 418/92 |

FOREIGN PATENT DOCUMENTS

| | | | |
|---|---|---|---|
| JP | 58-163692 | U | 10/1983 |
| JP | 1-203688 | A | 8/1989 |

OTHER PUBLICATIONS

Most recent claim set from Application No. 10/562,565 used in double patenting.*

* cited by examiner

*Primary Examiner*—Devon C Kramer
*Assistant Examiner*—Christopher Bobish
(74) *Attorney, Agent, or Firm*—Global IP Counselors

(57) ABSTRACT

A compression mechanism has a cylinder, a suction passage and a discharge passage. The suction passage of a cylinder is connected to a suction pipe. The discharge passage is open to an inner space of a sealed housing. A discharge gas is discharged through a discharge pipe. The cylinder is formed with a communicating passage extending from a suction passage to a suction pressure chamber to lead a suction gas in the suction passage into the suction pressure chamber and thereby allow a pressure of the suction gas in the suction passage to act on an outside surface of the cylinder.

10 Claims, 6 Drawing Sheets

HERMETIC COMPRESSOR

TECHNICAL FIELD

This invention relates to a hermetic compressor in which a compression mechanism and an electric motor are contained in a sealed housing, and particularly relates to its structure in which the compression mechanism and the electric motor are resiliently supported in the sealed housing.

BACKGROUND ART

An example of known hermetic compressors of this type is one in which an electric motor is integrally provided on top of a compression mechanism and a coil spring is interposed between the compression mechanism and the inner surface of the bottom wall of a sealed housing to inhibit the transmission of vibrations of the compression mechanism and the electric motor to the sealed housing and thereby reduce the noise of the compressor in operation (see, for example, Patent Document 1: Japanese Unexamined Patent Publication No. H01-203688 (Pages 3 and 4 and FIG. 1)).

In the above hermetic compressor in Patent Document 1, the upstream end of a suction passage is open at the sealed housing below the compression mechanism and a suction pipe is connected to the opening of the suction passage to extend to the outside of the sealed housing. Gas led through the suction pipe into the sealed housing is sucked into a compression chamber of the compression mechanism, compressed therein and then discharged through a discharge port into the sealed housing. Thereafter, the discharge gas in the sealed housing is led to the outside through a discharge pipe connected to the sealed housing.

Problems to be Solved

As described above, the hermetic compressor in Patent Document 1 employs a structure that gas compressed in the compression mechanism is discharged into the sealed housing. In this hermetic compressor, the sealed housing is filled with high-pressure discharge gas, so that the pressure of the discharge gas acts on the compression mechanism and the electric motor placed inside the sealed housing. On the other hand, low-pressure suction gas is led through the suction passage into the compression mechanism. In other words, the pressure of the suction gas acts on part of the compression mechanism in which the suction passage is formed. Therefore, a downward force acts on the compression mechanism owing to the difference between the discharge gas pressure and the suction gas pressure, so that the compression mechanism and the electric motor are pushed down.

If, like this, a downward force acts on the compression mechanism and the electric motor, the coil spring supporting both these components must bear both the gravity acting on the compression mechanism and the electric motor and the force due to the gas pressure difference. Therefore, the coil spring should be hardened accordingly, which causes a problem that vibrations transmitted from the compression mechanism and the electric motor to the sealed housing are increased.

Further, in order to prevent vibrations produced in the compression mechanism and the electric motor from being transmitted to the sealed housing, it is necessary to always keep the compression mechanism and the electric motor away from contact with the sealed housing. Therefore, if the positions of the compression mechanism and the electric motor are shifted inside the sealed housing because of the difference between the discharge gas pressure and the suction gas pressure as described before, this invites the need to ensure a larger clearance than necessary between the housing and the compression mechanism. As a result, a problem arises that the sealed housing is upsized.

The present invention has been made in view of the above points and its object is to restrain that when the compression mechanism and the electric motor are resiliently supported in the sealed housing, the positions of the compression mechanism and the electric motor are shifted because of the difference between the discharge gas pressure and the suction gas pressure, thereby achieving size reduction and noise reduction of the hermetic compressor.

DISCLOSURE OF THE INVENTION

To attain the above object, a first solution of the present invention is directed to a so-called high-pressure dome type hermetic compressor in which a suction pipe is connected to a suction passage of a compression mechanism while a discharge passage is communicated with the inner space of a sealed housing. Further, in the first solution, the suction gas pressure acts on the compression mechanism to reduce the pressing force acting on the compression mechanism owing to discharge gas.

More specifically, a first aspect of the invention is directed to a hermetic compressor in which a compression mechanism (20) for sucking gas into a compression chamber (22) and compressing the gas therein and an electric motor (30) for driving the compression mechanism (20) are contained in a sealed housing (10) and the compression mechanism (20) is supported, together with the electric motor (30), to the sealed housing (10) via a resilient member (65).

Further, the sealed housing (10) is connected to: a suction pipe (42) which leads suction gas into the hermetic compressor; and a discharge pipe (14) which leads discharge gas out of the hermetic compressor. Furthermore, the compression mechanism (20) is formed with: a suction passage (40) connected to the suction pipe (42) and open to the compression chamber (22); and a discharge passage (41) communicated with the inner space of the sealed housing (10) and open to the compression chamber (22). In addition, the hermetic compressor further comprises a differential pressure force canceling mechanism (52) for allowing the pressure of suction gas to act on the compression mechanism (20) so that the pressing force acting on the compression mechanism (20) along the axis of the suction passage (40) owing to discharge gas in the sealed housing (10) is reduced.

With the above structure, during operation of the hermetic compressor, the pressure of discharge gas in the sealed housing (10) acts on the compression mechanism (20). Further, since the suction pipe (42) is connected to the suction passage (40) of the compression mechanism (20), the pressure of suction gas led into the suction passage (40) also acts on the compression mechanism (20). The differential pressure force canceling mechanism (52) allows the pressure of suction gas to further act on the compression mechanism (20) already acted on by the pressures of discharge gas and suction gas. As a result, all the forces acting on the compression mechanism (20), which are owing to the pressure of discharge gas in the sealed housing (10) and the pressure of suction gas led into the suction passage (40) and the pressure of suction gas acting through the differential pressure force canceling mechanism (52), are canceled together. Therefore, the pressing force acting on the compression mechanism (20) along the axis of the suction passage (40) can be reduced.

In the first aspect of the invention, the differential pressure force canceling mechanism (52) may be configured to be able to only reduce the pressing force acting on the compression mechanism (20) along the axis of the suction passage (40) or may be configured to be able to reduce and cancel out the pressing force.

In a second aspect of the invention, relating to the first aspect of the invention, the compression mechanism (20) is formed of a rotary fluid machine in which the compression chamber (22) is defined between the inner periphery of a cylinder (23) and the outer periphery of a piston (25). Further, the suction passage (40) in the compression mechanism (20) is formed to pass through the cylinder (23) in a radial direction of the cylinder (23). The differential pressure force canceling mechanism (52) is configured to allow the pressure of suction gas to act on the outside surface of the cylinder (23) of the compression mechanism (20).

With the above structure, since the differential pressure force canceling mechanism (52) allows the suction gas pressure to act on the outside surface of the cylinder (23), the pressing force acting on the compression mechanism (20) along the axis of the suction passage (40) owing to discharge gas in the sealed housing (10), i.e., the pressing force in the radial direction of the cylinder (23), can be reduced. In this manner, the differential pressure force canceling mechanism (52) allows the suction gas pressure to act directly on the cylinder (23) of the compression mechanism (20) in which the suction passage (40) is formed.

In a third aspect of the invention, relating to the second aspect of the invention, the differential pressure force canceling mechanism (52) is configured to allow the pressure of suction gas to act on part of the outside surface of the cylinder (23) opposite to the suction passage (40).

With the above configuration, the differential pressure force canceling mechanism (52) allows the suction gas pressure to act on part of the outside surface of the cylinder (23) opposite to the suction passage (40) passing through the cylinder (23). Thus, the position shift of the compression mechanism (20) and electric motor (30) can be stably restrained even if the differential pressure force canceling mechanism (52) is configured to allow the suction gas pressure to act on a single point on the cylinder (23).

In a fourth aspect of the invention, relating to the second aspect of the invention, the differential pressure force canceling mechanism (52) has a suction pressure chamber (50) defined between the inner surface of the sealed housing (10) and the outside surface of the cylinder (23) and a communicating passage (51) which communicates the suction pressure chamber (50) with the suction passage (40) of the compression mechanism (20) and is configured to allow the gas pressure in the suction pressure chamber (50) to act on the cylinder (23).

With the above structure, the suction gas pressure in the suction passage (40) is led through the communicating passage (51) to the suction pressure chamber (50). The suction pressure chamber (50) is formed between the inner surface of the sealed housing (10) and the outside surface of the cylinder (23). Then, the suction gas pressure led to the suction pressure chamber (50) acts on the outside surface of the cylinder (23).

In a fifth aspect of the invention, relating to the fourth aspect of the invention, the communicating passage (51) of the differential pressure force canceling mechanism (52) is formed in the cylinder (23).

With the above structure, since the communicating passage (51) of the differential pressure force canceling mechanism (52) is formed in the cylinder (23) constituting part of the compression mechanism (20), this eliminates the need to provide a separate member constituting the communicating passage (51).

In a sixth aspect of the invention, relating to the fourth aspect of the invention, the communicating passage (51) of the differential pressure force canceling mechanism (52) is formed in an arcuate shape that extends along the inner periphery of the cylinder (23).

With the above structure, since the communicating passage (51) is formed between the outside surface and the inner periphery of the cylinder (23), heat transfer from the outside surface to inner periphery of the cylinder (23) can be inhibited by the communicating passage (51). Therefore, heat of high-temperature discharge gas in the sealed housing (10) becomes less likely to be transferred to the compression chamber (22).

In a seventh aspect of the invention, relating to the fourth aspect of the invention, the sealed housing (10) is connected to a plurality of suction pipes (42, 80), and one of the plurality of suction pipes (42, 80) is connected to the suction passage (40) of the compression mechanism (20) while the others are connected to the suction pressure chamber (50) of the differential pressure force canceling mechanism (52).

With the above structure, one suction pipe (42) of the plurality of suction pipes (42, 80) is communicated with the suction passage (40) and the other suction pipe (80) is communicated via the suction pressure chamber (50) and the communicating passage (51) with the suction passage (40). Therefore, the suction gas is sucked through the plurality of suction pipes (42, 80) into the compression mechanism (20), which reduces the flow rate of suction gas in each of the suction pipes (42, 80).

A second solution of the present invention is directed to a so-called low-pressure dome type hermetic compressor in which a suction passage of a compression mechanism is communicated with the inner space of a sealed housing and a discharge passage is connected to a discharge pipe. Further, in the second solution, the discharge gas pressure acts on the compression mechanism to cancel the force acting on the compression mechanism owing to the discharge gas pressure.

More specifically, an eighth aspect of the invention is directed to a hermetic compressor in which a compression mechanism (20) for sucking gas into a compression chamber (22) and compressing the gas therein and an electric motor (30) for driving the compression mechanism (20) are contained in a sealed housing (10) and the compression mechanism (20) is supported, together with the electric motor (30), to the sealed housing (10) via a resilient member (65).

Further, the sealed housing (10) is connected to: a suction pipe (42) which leads suction gas into the hermetic compressor; and a discharge pipe (14) which leads discharge gas out of the hermetic compressor. Furthermore, the compression mechanism (20) is formed with: a suction passage (40) communicated with the inner space of the sealed housing (10) and open to the compression chamber (22); and a discharge passage (41) connected to the discharge pipe (14) and open to the compression chamber (22). In addition, the hermetic compressor further comprises a differential pressure force canceling mechanism (52) for allowing the pressure of discharge gas discharged into the discharge pipe (14) to act on the compression mechanism (20) so that the force acting on the compression mechanism (20) owing to the discharge gas is canceled.

With the above structure, during operation of the hermetic compressor, the pressure of suction gas in the sealed housing (10) acts on the compression mechanism (20). Further, since discharge gas is led through the discharge passage (41) of the compression mechanism (20) into the discharge pipe (14), the pressure of discharge gas discharged through the discharge passage (41) also acts on the compression mechanism (20). The differential pressure force canceling mechanism (52)

allows the pressure of discharge gas to further act on the compression mechanism (20) already acted on by the pressure of discharge gas and the pressure of suction gas. As a result, the forces acting on the compression mechanism (20), which are owing to the pressure of suction gas in the sealed housing (10), the pressure of discharge gas discharged through the discharge passage (41) and the pressure of discharge gas acting through the differential pressure force canceling mechanism (52), are cancelled together.

In the eighth aspect of the invention, the differential pressure force canceling mechanism (52) may be configured to be able to only reduce the force acting on the compression mechanism (20) or may be configured to be able to reduce and cancel out the force.

In a ninth aspect of the invention, relating to the eighth aspect of the invention, the compression mechanism (20) is formed of a rotary fluid machine in which the compression chamber (22) is defined between the inner periphery of a cylinder (23) and the outer periphery of a piston (25). Further, the discharge passage (41) in the compression mechanism (20) is open at the outside surface of the cylinder (23) and the discharge pipe (14) is connected to an opening of the discharge passage (41) located at the outside surface of the cylinder (23). The differential pressure force canceling mechanism (52) is configured to allow the pressure of discharge gas to act on the outside surface of the cylinder (23) of the compression mechanism (20).

With the above structure, since the differential pressure force canceling mechanism (52) allows the discharge gas pressure to act on the outside surface of the cylinder (23), the force acting on the compression mechanism (20) owing to discharge gas in the discharge pipe (14), i.e., the pressing force in the radial direction of the cylinder (23), can be reduced. In this manner, the differential pressure force canceling mechanism (52) allows the discharge gas pressure to act directly on the cylinder (23) of the compression mechanism (20) to which the discharge pipe (14) is connected.

In a tenth aspect of the invention, relating to the eighth aspect of the invention, the compression mechanism (20) is formed of a rotary fluid machine in which the compression chamber (22) is defined between the inner periphery of a cylinder (23) and the outer periphery of a piston (25). Further, out of a pair of end plate members (54, 55) that close the end surfaces of the cylinder (23) of the compression mechanism (20), a first said end plate member (54) is passed through by the discharge passage (41). Furthermore, the discharge pipe (14) is communicated with the discharge passage (41). The differential pressure force canceling mechanism (52) is configured to allow the pressure of discharge gas to act on a second said end plate member (55) of the compression mechanism (20).

With the above structure, the first end plate member (54) is formed with the discharge passage (41) and the force toward the second end plate member (55) acts on the compression mechanism (20) owing to the pressure of discharge gas discharged through the discharge passage (41). On the other hand, the differential pressure force canceling mechanism (52) allows the discharge gas pressure to act on the second end plate member (55) opposed to the first end plate member (54) with the cylinder (23) interposed therebetween. Owing to the discharge gas pressure acting through the differential pressure force canceling mechanism (52), the force toward the first end plate member (54) acts on the compression mechanism (20). As a result, the force acting on the compression mechanism (20) owing to the pressure of discharge gas discharged through the discharge passage (41) is cancelled out with the force acting on the compression mechanism (20) through the differential pressure force canceling mechanism (52).

Effects of the Invention

In the first aspect of the invention, the hermetic compressor is provided with the differential pressure force canceling mechanism (52) to reduce the pressing force acting on the compression mechanism (20) along the axis of the suction passage (40) owing to discharge gas in the sealed housing (10). This restrains the position shift of the compression mechanism (20) and electric motor (30) owing to the difference between the discharge gas pressure and suction gas pressure in the sealed housing (10). Since the position shift of the compression mechanism (20) and electric motor (30) can be thus restrained, the hardness of the resilient member (65) can be set at such a value as required to bear only the gravity acting on the compression mechanism (20) and the electric motor (30). As a result, the compression mechanism (20) and the electric motor (30) are flexibly supported so that vibrations can be inhibited from being transmitted from the compression mechanism (20) and electric motor (30) to the sealed housing (10). Therefore, the noise of the hermetic compressor can be reduced.

Further, since the position shift of the compression mechanism (20) and electric motor (30) can be restrained in the above manner, this eliminates the need to ensure larger clearance than necessary between the sealed housing (10) and both of the compression mechanism (20) and the electric motor (30). Therefore, the sealed housing (10) can be downsized and in turn the hermetic compressor can be downsized.

In the second aspect of the invention, the suction passage (40) radially passing through the cylinder (23) is formed in the compression mechanism (20) formed of a rotary fluid machine and the differential pressure force canceling mechanism (52) allows the suction gas pressure to act on the outside surface of the cylinder (23). Therefore, the suction gas pressure acts directly on the cylinder (23) formed with the suction passage (40), which restrains the position shift of the compression mechanism (20) and electric motor (30) with ease and stability.

In the third aspect of the invention, the differential pressure force canceling mechanism (52) allows the suction gas pressure to act on part of the outside surface of the cylinder (23) opposite to the suction passage (40). Therefore, even if, for example, the differential pressure force canceling mechanism (52) is configured to allow the suction gas pressure to act on a single point on the cylinder (23), it can stably restrain the position shift of the compression mechanism (20) and electric motor (30). This simplifies the structure of the differential pressure force canceling mechanism (52) and thereby reduces the cost of the hermetic compressor.

In the fourth aspect of the invention, the differential pressure force canceling mechanism (52) is formed with the suction pressure chamber (50) and the communicating passage (51) and is configured to allow the suction gas pressure led into the suction pressure chamber (50) to act on the cylinder (23). Therefore, the differential pressure force canceling mechanism (52) can be achieved with a relatively simple structure, which restrains the hermetic compressor from increasing in cost for the reason of provision of the differential pressure force canceling mechanism (52).

In the fifth aspect of the invention, since the communicating passage (51) of the differential pressure force canceling mechanism (52) is formed in the cylinder (23), this eliminate the need to provide a separate member constituting the communicating passage (51). This restrains the number of parts from increasing for the reason of provision of the differential pressure force canceling mechanism (52) and avoids the upsizing of the hermetic compressor.

In the sixth aspect of the invention, the communicating passage (51) formed in the cylinder (23) is used to make it difficult to transfer heat of high-temperature discharge gas in the sealed housing (10) to the compression chamber (22). This reduces the amount of heat transferred from the discharge gas in the sealed housing (10) to the suction gas in the compression chamber (22), thereby enhancing the efficiency of compression work.

In the seventh aspect of the invention, since the plurality of suction pipes (42) are connected to the sealed housing (10) using the suction pressure chamber (50) of the differential pressure force canceling mechanism (52), the flow rate of suction gas in each of the suction pipes (42) can be decreased so that the pressure loss of suction gas until it is sucked in the compression mechanism (20) can be reduced. This restrains the pressure drop of suction gas flowing into the compression chamber (22) and thereby enhances the efficiency of the compression mechanism (20).

In the eighth aspect of the invention, the hermetic compressor is provided with the differential pressure force canceling mechanism (52) to cancel out the force of discharge gas discharged into the discharge pipe (14) on the compression mechanism (20). Therefore, the compression mechanism (20) and the electric motor (30) can be restrained from shifting their positions. This, like the first aspect of the invention, reduces the noise of the hermetic compressor and downsizes the hermetic compressor.

In the ninth aspect of the invention, the discharge pipe (14) is connected to the opening of the discharge passage (41) in the cylinder (23) of the compression mechanism (20) formed of a rotary fluid machine and the differential pressure force canceling mechanism (52) allows the discharge gas pressure to act on the outside surface of the cylinder (23). Therefore, the discharge gas pressure acts directly on the cylinder (23) connected to the discharge pipe (14), which restrains the position shift of the compression mechanism (20) and electric motor (30) with ease and stability.

In the tenth aspect of the invention, since the differential pressure force canceling mechanism (52) allows the discharge gas pressure to act on the second end plate member (55) opposed to the first end plate member (54) formed with the discharge passage (41), the position shift of the compression mechanism (20) and electric motor (30) can be restrained with ease and stability.

BEST MODE FOR CARRYING OUT THE INVENTION

Embodiments of the present invention will be described below in detail with reference to the drawings.

Figure 1:
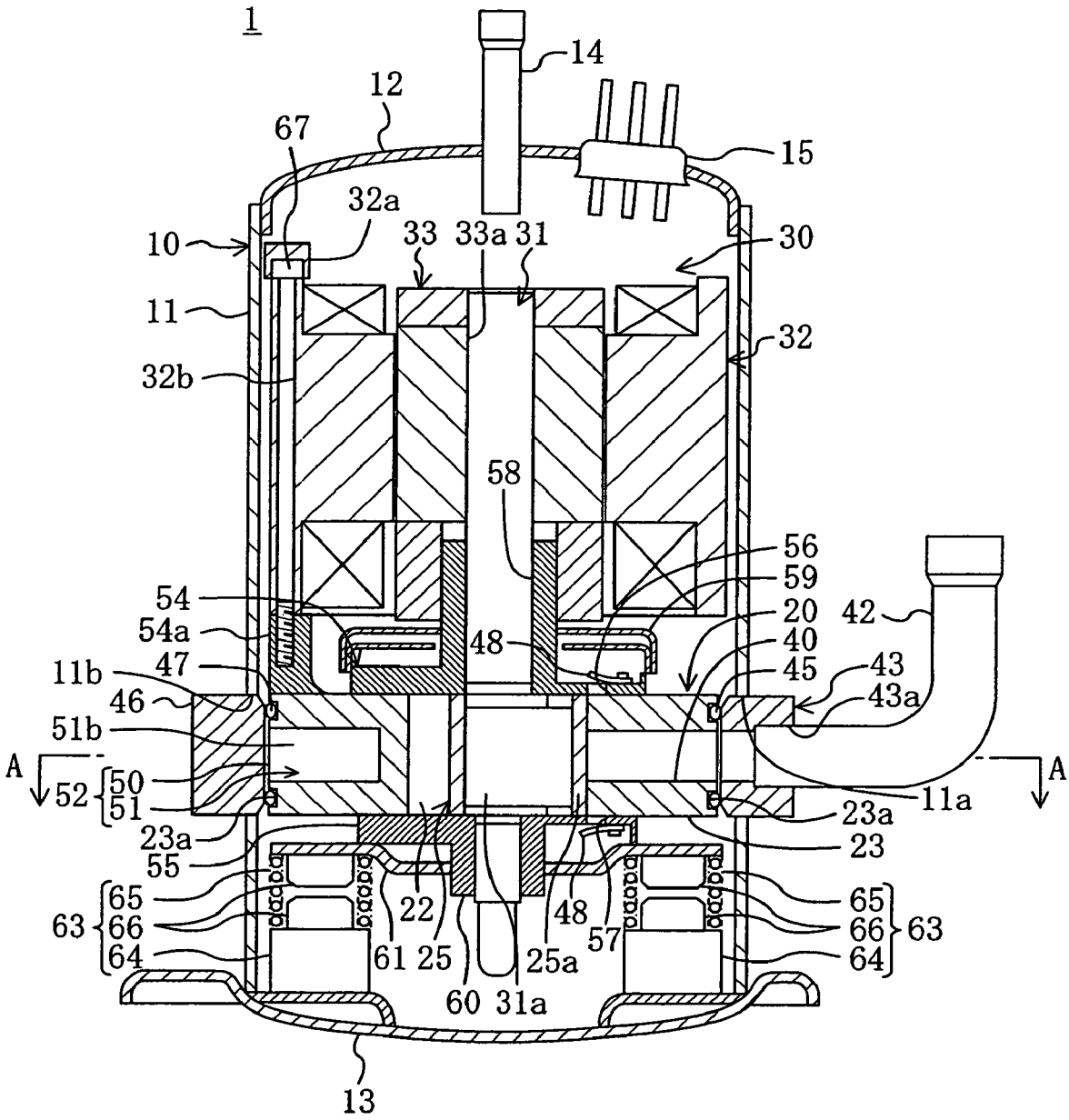
FIG. 1 is a longitudinal cross section showing a schematic structure of a hermetic compressor according to an embodiment of the present invention.

FIG. 1 shows an embodiment of the present invention applied to a so-called "rocking piston type" rotary compressor (1). This compressor is configured to compress refrigerant during a cooling cycle in an air conditioner. In this compressor (1), a sealed housing (10) contains a compression mechanism (20) and an electric motor (30) which are connected to each other through a drive shaft (31). The electric motor (30) is placed above and joined integrally to the compression mechanism (20). The compression mechanism (20) is resiliently supported to the sealed housing (10) via mounting mechanisms (63).

The sealed housing (10) is formed in a size that a predetermined clearance is left between the sealed housing (10) and both of the compression mechanism (20) and the electric motor (30) so that the compression mechanism (20) and electric motor (30) in operation cannot be made contact with the inner surface of the sealed housing (10). Further, the sealed housing (10) has a vertically elongated barrel (11), a saucer-shaped upper end plate (12) fitted into the upper end of the barrel (11), and a lower end plate (13) placed at the bottom of the barrel (11) and having a larger diameter than the outside diameter of the barrel (11). The barrel (11), the upper end plate (12) and the lower end plate (13) are bonded together by welding the upper and lower ends of the barrel (11) all around to the upper end plate (12) and the lower end plate (13), respectively.

The upper end plate (12) is provided substantially at the center with a discharge pipe (14) vertically penetrating the upper end plate (12). Further, a terminal (16) for supplying electricity to the electric motor (30) is disposed in part of the upper end plate (12) radially away from the discharge pipe (14).

The sealed housing (10) is equipped with two block members (43, 46). Each block member (43, 46) is formed in a relatively short column. Further, the head surface of each block member (43, 46) is rounded at the entire circumference. Out of the two block members (43, 46), the first block member (43) is formed with a through hole (43*a*). The through hole (43*a*) is formed coaxially with the first block member (43) and open at the head and bottom surfaces of the first block member (43). One end of a suction pipe (42) is inserted in the through hole (43*a*) of the first block member (43). On the other hand, the remaining second block member (46) is solid.

The block members (43, 46) are attached to the barrel (11). Specifically, two insertion holes (11*a*, 11*b*) for inserting the block members (43, 46) therein are formed in opposed positions, one by one, in parts of the barrel (11) slightly lower than its vertical middle. The head of the first block member (43) is inserted in one insertion hole (11*a*), while the head of the second block member (46) is inserted in the other insertion hole (11*b*). In this state, each block member (43, 46) is welded to the barrel (11). In other words, the block members (43, 46) are disposed, one by one, on the same level of the barrel (11) and 180 degrees circumferentially away from each other, so that the head surfaces of the block members (43, 46) are opposed to each other. Further, the head surfaces of the block members (43, 36) inserted in the barrel (11) form parts of the inner surface of the sealed housing (10).

The compression mechanism (20) includes a cylinder (23) formed in a substantially cylindrical shape. On top of the cylinder (23), a front head (54) is placed as a first end plate member for closing an opening of the cylinder (23) located in the top surface thereof. On the other hand, on the bottom of the cylinder (23), a rear head (55) is placed as a second end plate member for closing another opening of the cylinder (23) located in the bottom surface thereof. The front head (54) and the rear head (55) are joined integrally to the cylinder (23) by fastening using bolts or the like (not shown). The compression mechanism (20) is positioned so that the center line of the cylinder (23) substantially coincides with the center line of the barrel (11).

A rocking piston (25) is inserted in the cylinder (23) to rock with the rotation of the drive shaft (31). Further, in the cylinder (23), a compression chamber (22) is defined by the outer periphery of the rocking piston (25), the inner periphery of the cylinder (23), the bottom surface of the front head (54) and the top surface of the rear head (55).

Figure 2:
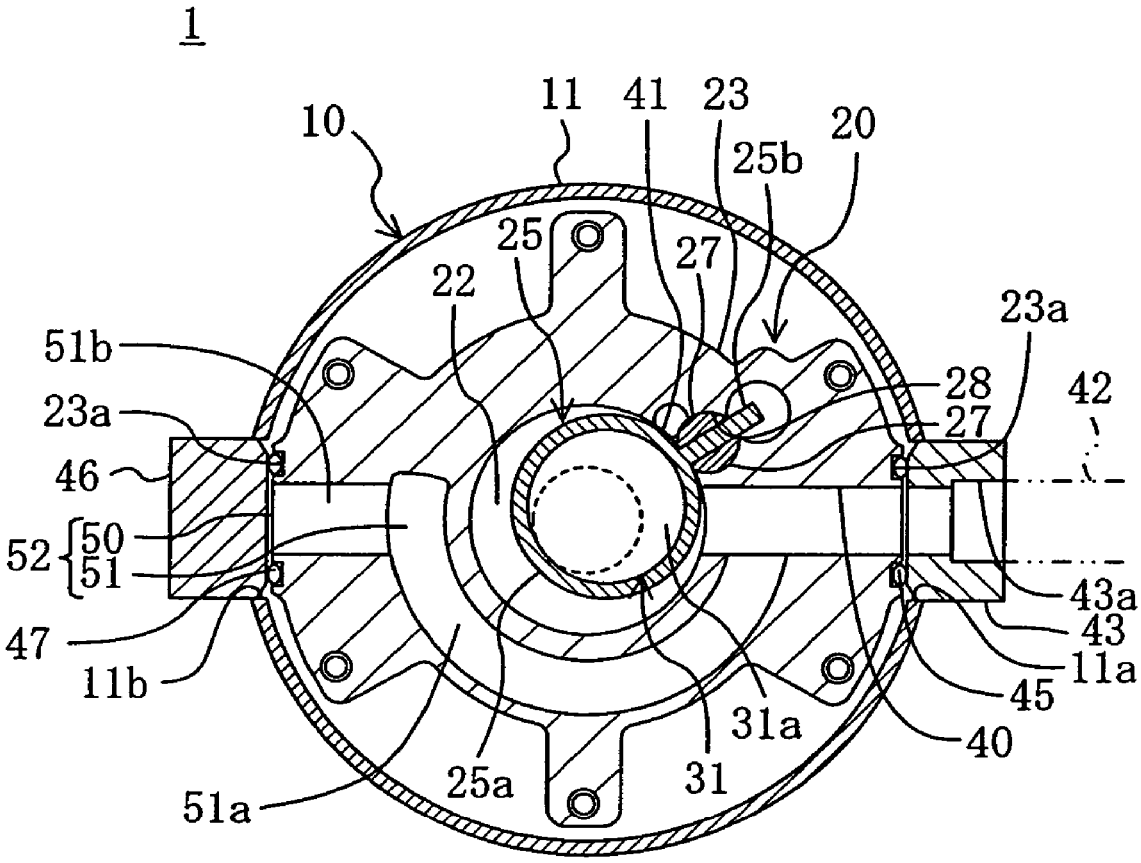
FIG. 2 is a cross section taken along the line A-A of FIG. 1.

As shown in FIG. 2, the rocking piston (25) is constructed so that an annular body (25*a*) is formed integrally with a flat blade (25*b*) extending radially outward from a point on the outer periphery of the body (25*a*). The body (25*a*) is formed so that during its rocking movement, its outer periphery comes substantially in line contact with the inner periphery of the cylinder (23). Further, the blade (25*b*) is inserted in and supported to an insertion hole (28) formed in part of the cylinder (23) located outwardly of the compression chamber (22), so as to be sandwiched between a pair of bushes (27) in the insertion hole (28). The blade (25*b*) divides the compression chamber (22) into low-pressure and high-pressure sides.

The cylinder (23) is formed with a suction passage (40). One end of the suction passage (40) is open at part of the inner periphery of the cylinder (23) adjoining the low-pressure side of the compression chamber (22). The suction passage (40) extends linearly from the one end radially outward along the center line of the cylinder (23). The distal end of the suction passage (40) is open at the outside surface of the cylinder (23). Further, the cylinder (23) is formed with two discharge passages (41) just beside the bush (27). The discharge passages (41) are formed in pair so that one is bored from the top surface of the cylinder (23) and the other is bored from the bottom surface thereof.

The cylinder (23) is also formed with a communicating passage (51). The communicating passage (51) is constituted by an arcuate section (51*a*) and a linear section (51*b*). The arcuate section (51*a*) extends substantially semi-circularly along the half of the inner periphery of the cylinder (23) adjoining the low-pressure side of the compression chamber (22). The root end of the arcuate section (15*a*) is connected to the suction passage (40), while the distal end thereof is located at a position in the cylinder (23) opposite to the suction passage (40). On the other hand, the linear section (51*b*) of the communicating passage (51) extends linearly from the distal end of the arcuate section (51*a*) radially outward of the cylinder (23). The linear section (51*b*) is formed so that its central axis is located on the central axis of the suction passage (40). Further, the distal end of the linear section (51*b*) of the communicating passage (51) is open at the outside surface of the cylinder (23).

The front head (54) and the rear head (55) are formed with head's discharge passages (56, 57) communicating with the discharge passages (41), respectively, located in the cylinder (23). The top surface of the front head (54) and the bottom surface of the rear head (55) are provided with discharge valves (48) for opening/closing the head's discharge passages (56, 57), respectively. The discharge valves (48) are each composed of a lead valve. The head's discharge passages (56, 57) are communicated with the inner space of the sealed housing (10) when the discharge valves (48) are opened. Therefore, this compressor (1) is constructed as a so-called high-pressure dome type compressor in which the suction passage (40) of the compression mechanism (20) is connected to the suction pipe (42) and the discharge passages (56, 57) thereof are communicated with the inner space of the sealed housing (10).

The front head (54) is formed at the center with an upwardly extending cylindrical part (58). The cylindrical part (58) constitutes a sliding bearing for supporting the drive shaft (31). A substantially disc-shaped upper muffler (59) is fixed to the front head (54) to cover the head's discharge passage (56) from above. On the other hand, the rear head (55) is also formed at the center with a downwardly extending cylindrical part (60). The cylindrical part (60) also constitutes a sliding bearing for supporting the drive shaft (31). A substantially disc-shaped lower muffler (61) is fixed to the rear head (55) to cover the head's discharge passage (57) from below. The lower muffler (61) acts to prevent refrigeration oil in the lower part of the barrel (11) from flowing into the discharge passages (41, 57) of the cylinder (23).

The lower muffler (61) is formed of a thicker plate material than the upper muffler (59). A plurality of mounting mechanisms (63) are disposed on the outer periphery of the bottom surface of the lower muffler (61) at circumferentially spaced intervals. Each mounting mechanism (63) is composed of a mount (64) fixed to the lower end plate (13), a coil spring (65) as a resilient member anchored to the top of the mount (64) to extend upward from the mount (64) and anchored at its upper end to the underside of the lower muffler (61), and a stopper (66) for restricting the compression of the coil spring (65). In this manner, the lower muffler (61) also acts as a bracket through which the compression mechanism (20) is mounted on the coil springs (65).

The compression mechanism (20) is positioned substantially on the same level as the first and second block members (43, 46) attached to the sealed housing (10). Further, the compression mechanism (20) is placed so that the opening of the suction passage (40) in the outside surface of the cylinder (20) faces the first block member (43) and the opening of the communicating passage (51) in the outside surface of the cylinder (23) faces the second block member (46).

The part of the outside surface of the cylinder (23) at which the suction passage (40) is open extends slightly outward in the radial direction of the cylinder (23). The end surface of the above slightly extending part forms a flat surface, at which the suction passage (40) is open. The flat end surface at which the suction passage (40) is open faces the head surface of the first block member (43), which is also flat. A relatively narrow clearance is left between these two flat surfaces. Further, the cylinder (23) is formed with an annular groove (23*a*) to surround the opening of the suction passage (40) in the end surface of the above extending part. The annular groove (23*a*) is formed by digging the outside surface of the cylinder (23) all around the opening of the suction passage (40). The annular groove (23*a*) is formed with a larger diameter than the opening edge of the suction passage (40).

An O-ring (45) is fitted in the annular groove (23*a*). The O-ring (45) is formed with a larger diameter than the opening of the suction passage (40) of the cylinder (23) and the through hole (43*a*) of the first block member (43). The size of the O-ring (45) is selected so that it can be brought into tight contact with both the bottom surface of the annular groove (23*a*) of the cylinder (23) and the head surface of the first block member (43) and can be squashed between the cylinder (23) and the first block member (43). Further, the O-ring (45) is kept in tight contact with both the cylinder (23) and the first block member (43) even if the compression mechanism (20) shifts its position during operation.

Further, since the outer periphery of the O-ring (45) faces the inner space of the sealed housing (10), the pressure of the discharge gas in the inner space of the sealed housing (10) acts on the outer periphery of the O-ring (45). Therefore, the O-ring (45) receives a force to tend to deform it in the direction to reduce its diameter. Since, however, the inner periphery of the O-ring (45) is held on the side surface of the annular groove (23*a*) toward the opening of the suction passage (40), this prevents the O-ring (45) from deforming in the direction to reduce its diameter.

In this manner, the O-ring (45) seals the clearance between the cylinder (23) and the first block member (43) to ensure air-tightness through the suction gas passage from the suction pipe (42) to the suction passage (40).

The part of the outside surface of the cylinder (23) at which the linear section (51*b*) of the communicating passage (51) is open extends slightly outward in the radial direction of the cylinder (23). The end surface of the above slightly extending part forms a flat surface, at which the communicating passage (51) is open. The flat end surface at which the communicating passage (51) is open faces the head surface of the second block member (46), which is also flat. A relatively narrow clearance is left between these two flat surfaces. Further, the cylinder (23) is formed with an annular groove (23*a*) to surround the opening of the communicating passage (51) in the end surface of the above extending part. The annular groove (23*a*) is formed by digging the outside surface of the cylinder (23) all around the opening of the communicating passage (51). The annular groove (23*a*) is formed with a larger diameter than the opening edge of the communicating passage (51).

An O-ring (47) is fitted in the annular groove (23*a*). The O-ring (47) is formed with a larger diameter than the opening of the linear section (51*b*) of the communicating passage (51) and has the same diameter as the O-ring (45) provided at the suction passage (40) side of the cylinder (23). The size of the O-ring (47) is selected so that it can be brought into tight contact with both the bottom surface of the annular groove (23*a*) of the cylinder (23) and the head surface of the second block member (46) and can be squashed between the cylinder (23) and the second block member (46). Further, the O-ring (47) is kept in tight contact with both the cylinder (23) and the second block member (46) even if the compression mechanism (20) shifts its position during operation.

Further, since the outer periphery of the O-ring (47) faces the inner space of the sealed housing (10), the pressure of the discharge gas in the inner space of the sealed housing (10) acts on the outer periphery of the O-ring (47). Therefore, the O-ring (47) receives a force to tend to deform it in the direction to reduce its diameter. Since, however, the inner periphery of the O-ring (47) is held on the side surface of the annular groove (23*a*) toward the opening of the communicating passage (51), this prevents the O-ring (47) from deforming in the direction to reduce its diameter.

In the clearance between the cylinder (23) and the second block member (46), its portion located within the O-ring (47) forms a suction pressure chamber (50) separated from the surrounding parts. The suction pressure chamber (50) is divided from the inner space of the sealed housing (10) filled with discharge gas and communicates with the suction passage (49) via the communicating passage (51). Further, the air-tightness of the suction pressure chamber (50) is held by the O-ring is (47) in tight contact with the cylinder (23) and the second block member (46). The suction pressure chamber (50) and the communicating passage (51) constitute a differential pressure force canceling mechanism (52).

A brushless DC motor is used as the electric motor (30). The electric motor (30) is composed of a cylindrical stator (32) fixed to the front head (54) of the compression mechanism (20), and a rotor (33) placed rotatably in the stator (32). The drive shaft (31) is inserted and fixed into a center hole (33*a*) of the rotor (33).

The drive shaft (31) is positioned so that its center line substantially coincides with the center line of the cylinder (23). The lower portion of the drive shaft (31) is formed with an eccentric part (31*a*). The eccentric part (31*a*) is formed with a larger diameter than the other parts of the drive shaft (31) and its center line is eccentric with respect to the axis of the drive shaft (31). Further, the drive shaft (31) passes through the body (25*a*) of the rocking piston (25) placed in the cylinder (23) so that the outer periphery of the eccentric part (31*a*) can slide on the inner periphery of the body (25*a*).

The rim of the stator (32) has a plurality of circumferentially spaced projections (32*a*) extending to the proximity of the lower end of the upper end plate (12). Parts of the stator (32) just below the projections (32*a*) are formed with vertically penetrating through holes (32*b*), respectively. On the other hand, the top of the front head (54) of the compression mechanism (20) is formed with bosses (54*a*) associated with the through holes (32*b*) of the stator (32). The stator (32) is fixed integrally to the front head (54) by inserting bolts (67) into the through holes (32*b*) and screwing them into the bosses (54*a*), respectively.

The projections (32*a*) of the stator (32) are provided for the purpose of preventing an excessive position shift of the compression mechanism (20) and electric motor (30). For example, when a large excitation force is applied to the compression mechanism (20) and the electric motor (30) because of vibrations during transportation of the compressor (1), the projections (32*a*) abut on the lower end of the upper end plate (12) to thereby prevent an excessive position shift of the compression mechanism (20) and electric motor (30).

In the compressor (1) having the above structure, when the electric motor (30) is activated to rock the rocking piston (25), suction gas led through the suction pipe (42) into the compressor (1) is sucked into the compression chamber (22) through the suction passage (40). The suction gas sucked in the compression chamber (22) is compressed by the rocking piston (25). Then, the compressed gas passes through the discharge passage (41) in the cylinder (23) and the head's discharge passages (56, 57) in this order. The pressure of the discharge gas at this time causes the discharge valves (48) to open so that the compressed gas refrigerant in the compression chamber (22) is discharged as discharge gas into the sealed housing (10). The inner space of the sealed housing (10) is filled with discharge gas from the compression mechanism (20) and thereby put under high pressure. Thereafter, the discharge gas is led through the discharge pipe (14) to the outside of the sealed housing (10).

Effects of Embodiment

During operation of the above compressor (1), vibrations of the electric motor (30) occur and vibrations of the compression mechanism (20) occur owing to torque variations caused by its compression work. Since in the above compressor (1) the compression mechanism (20) and the electric motor (30) are mounted on the coil springs (65), vibrations generated by the compression mechanism (20) and the electric motor (30) are absorbed to some extent by the coil springs (65). This reduces vibrations transmitted from the compression mechanism (20) and the electric motor (30) to the sealed housing (10).

Further, since in the above compressor (1) the O-ring (45) is interposed between the outside surface of the cylinder (23) and the first block member (43), vibrations transmitted from the cylinder (23) to the suction pipe (42) can be restrained. Therefore, according to this embodiment, the noise of the compressor (1) can be reduced.

Furthermore, since the above compressor (1) is constructed as a high-pressure dome type one, the high pressure of the discharge gas in the sealed housing (10) acts uniformly on the entire compression mechanism (20) and the entire electric motor (30). On the other hand, low-pressure suction gas is led through the suction pipe (42) into the suction passage (40) of the cylinder (23) of the compression mechanism (20). Therefore, the pressure of suction gas acts on a region of the compressor (1) within the O-ring (45) located toward the suction passage (40). Further, the compressor (1) is provided with the differential pressure force canceling mechanism (52) and the pressure of suction gas in the suction passage (40) is led into the suction pressure chamber (50) through the communicating passage (51). Therefore, the pressure of suction gas also acts on a region of the cylinder (23) within the O-ring (47) located opposite to the suction passage (40).

To sum up, while the pressure of discharge gas in the sealed housing (10) acts on the entire compression mechanism (20), pressures of suction gas in opposite directions act on equal-area regions of the cylinder (23) of the compression mechanism (20) toward and opposite to the suction passage (40). Thus, all the forces acting on the compression mechanism (20) owing to the discharge gas pressure and suction gas pressure on the compression mechanism (20) are cancelled out, which reduces the pressing force acting on the compression mechanism (20) along the axis of the suction passage (40) to substantially zero.

Since, therefore, the force due to the difference between the discharge gas pressure and the suction gas pressure does not act on the compression mechanism (20), the spring constant of the coil springs (65) can be set at a value as small as required to bear only the gravity acting on the compression mechanism (20) and the electric motor (30). Hence, the spring constant of the coil springs (65) can be softened. This further makes it difficult to transmit vibrations of the compression mechanism (20) and the electric motor (30) to the housing and thereby reduces the noise of the compressor (1) well.

Further, since the pressing force acting on the compression mechanism (20) along the axis of the suction passage (40) is reduced by the differential pressure force canceling mechanism (52) as described above, the position shift of the compression mechanism (20) and the electric motor (30) can be restrained. As a result, the clearance between the compression mechanism (20) and the inner surface of the sealed housing (10) can be reduced. Therefore, the sealed housing (10) can be formed with a smaller size by the amount of reduction of the clearance, which permits downsizing of the compressor (1).

Further, the above embodiment is configured so that the suction gas pressure acts on part of the outside surface of the cylinder (23) opposite to the suction passage (40). Specifically, the differential pressure force canceling mechanism (52) is configured to allow the suction gas pressure to act on a single point on the outside surface of the cylinder (23). This stably reduces the pressing force along the axis of the suction passage (40). Therefore, the structure of the differential pressure force canceling mechanism (52) can be simplified, which reduces the cost of the compressor (1). Furthermore, since the differential pressure force canceling mechanism (52) allows the suction gas pressure to act directly on the outside surface of the cylinder (23), the position shift of the compression mechanism (20) and the electric motor (30) can be restrained with ease and stability.

In the above embodiment, the suction pressure chamber (50) is formed between the head surface of the second block member (46) and the outside surface of the cylinder (23) so that the pressure of suction gas led through the communicating passage (51) acts on the outside surface of the cylinder (23). Therefore, the differential pressure force canceling mechanism (52) can be achieved with a relatively simple structure, which restrains the compressor (1) from increasing in cost for the reason of provision of the differential pressure force canceling mechanism (52). Further, if the part of the outside surface of the cylinder (23) forming the suction pressure chamber (50) is changed in area, the force on the cylinder (23) can be also changed which is created by the differential pressure force canceling mechanism (52).

Since the communicating passage (51) of the differential pressure force canceling mechanism (52) is formed in the cylinder (23), a separate member forming the communicating passage (51) can be dispensed with. This prevents the number of parts from increasing for the reason of provision of the differential pressure force canceling mechanism (52) and avoids upsizing of the compressor (1).

Since the communicating passage (51) is formed to extend along the low-pressure side inner periphery of the compression chamber (22) of the cylinder (23), a space is created between the outside surface of the cylinder (23) and the compression chamber (22). Thus, the communicating passage (51) inhibits heat transfer from the outside surface to inner periphery of the cylinder (23). As a result, heat of high-temperature discharge gas discharged into the sealed housing (10) becomes less likely to be transferred to the compression chamber (22). This restrains heating of suction gas sucked in the compression chamber (22) and thereby enhances the efficiency of compression work.

The above embodiment is configured so that the differential pressure force canceling mechanism (52) allows the suction gas pressure to act on a single point on the cylinder (23). The present invention is not limited to the above configuration but may be configured so that, though not shown, the suction gas pressure acts on plural points on the cylinder (23). Specifically, if the differential pressure force canceling mechanism (52) allows the suction gas pressure to act on two points on the outside surface of the cylinder (23), suction pressure chambers of the same configuration as in the above embodiment are formed at substantially regular intervals, i.e., at intervals of 120°, along the circumference of the cylinder (23) with respect to the formation point of the suction passage (40) in the cylinder (23). Further, the cylinder (23) is formed with a plurality of communicating passages which communicates the suction passage (40) with each of the suction pressure chambers.

Likewise, if the differential pressure canceling mechanism (52) allows the suction gas pressure to act on three points on the outside surface of the cylinder (23), suction pressure chambers are formed at intervals of 90°. If, like these cases, the suction gas pressure acts on the outside of the cylinder (23) at substantially regular intervals, the pressing force acting on the compression mechanism (20) can be stably reduced.

Figure 3:
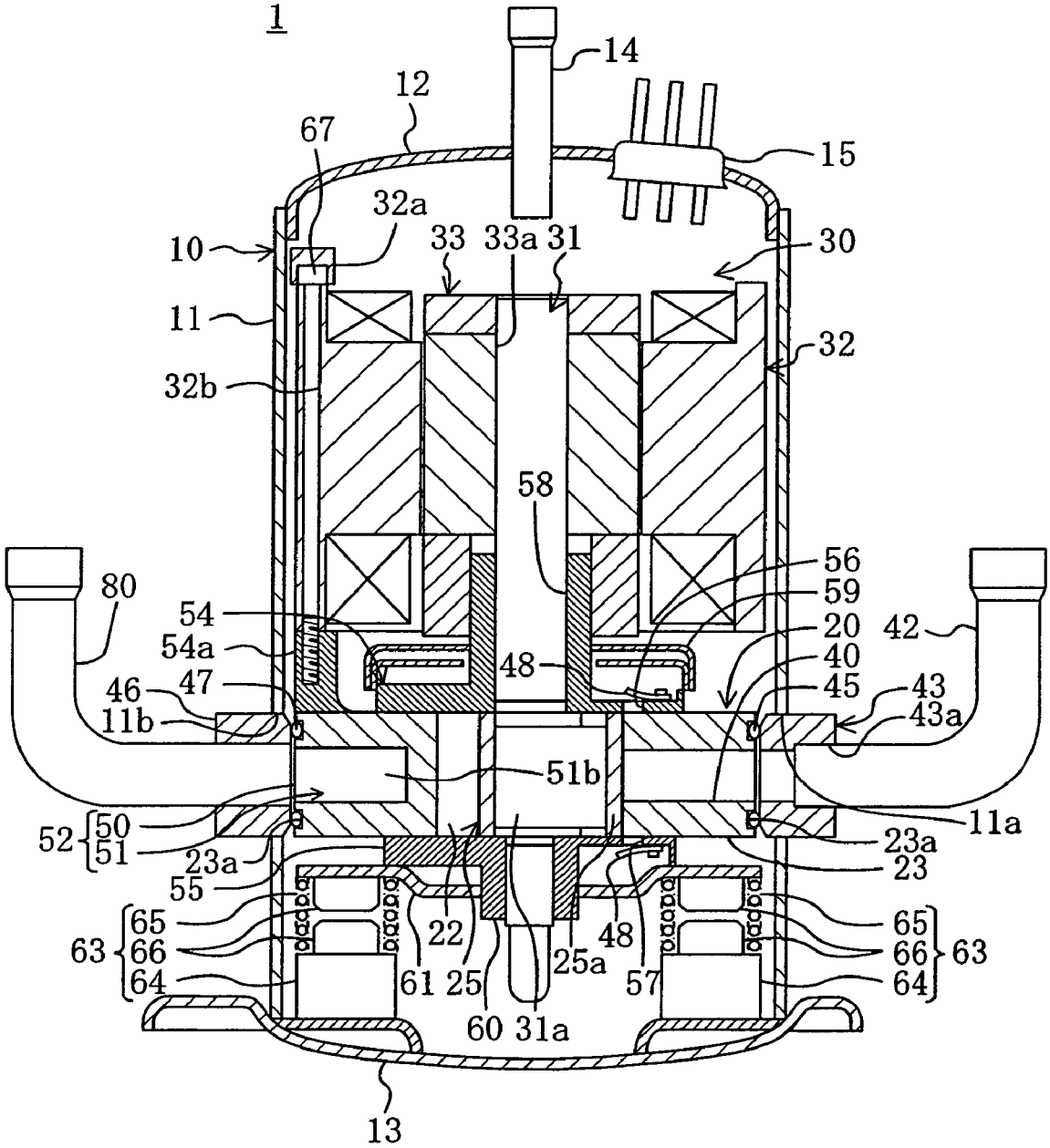
FIG. 3 is a corresponding view of FIG. 1 according to a variant.
Figure 4:
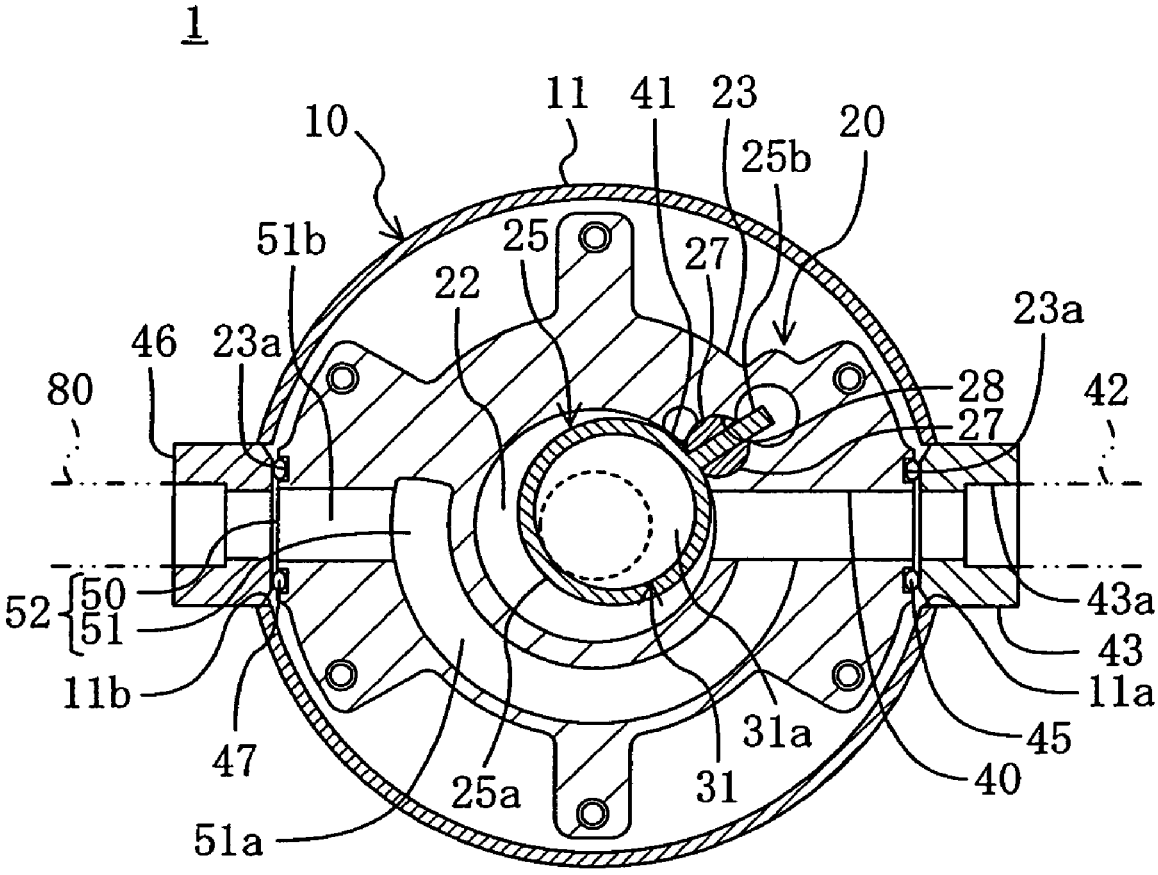
FIG. 4 is a corresponding view of FIG. 2 according to the variant.

Though a single suction pipe (42) is disposed in the above embodiment, two suction pipes can be disposed as in a variant shown in FIGS. 3 and 4. In this case, the second block member (46) is configured to have the same configuration as the first block member (43) and one end of a suction pipe (80) similar to the suction pipe (42) is inserted into the through hole of the second block member (46). Since the suction pipe (80) communicates with the suction passage (40) via the communicating passage (51), suction gas is sucked into the compression chamber (22) through the two suction pipes (42, 80). As a result, the flow rate of suction gas in each of the suction pipes (42, 80) is decreased. This reduces the pressure loss of suction gas until it is sucked into the compression chamber (22), thereby enhancing the efficiency of the compression mechanism (20). If two or more suction pressure chambers are provided, the number of suction pipes is increased accordingly.

Another Embodiment

Figure 5:
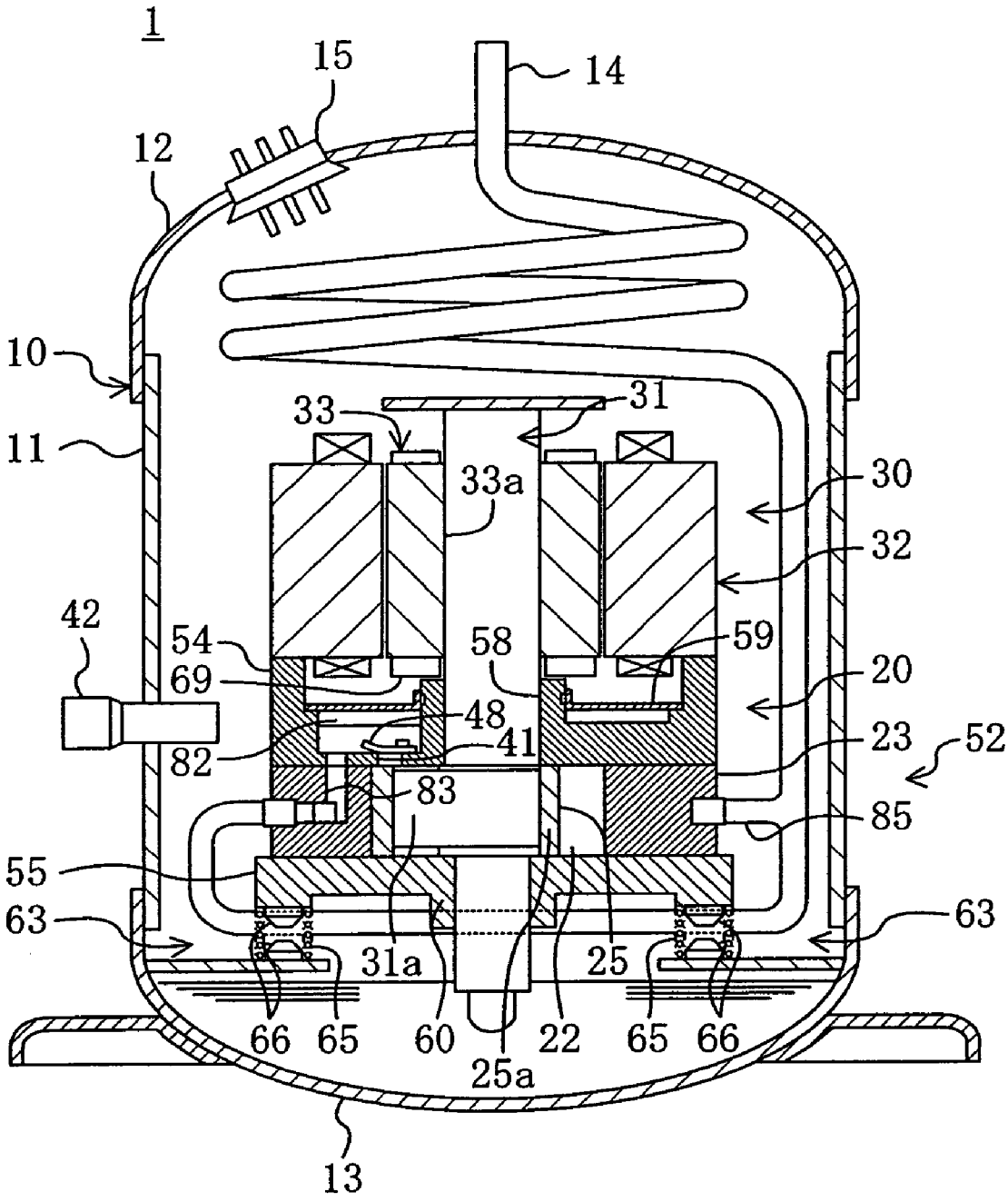
FIG. 5 is a corresponding view of FIG. 1 according to another embodiment.

The present invention is not limited to the above embodiment but includes various other embodiments. The above embodiment is described for the case where the present invention is applied to a high-pressure dome type hermetic compressor. The present invention is not limited to the above case but may be applied to another embodiment as shown in FIG. 5, i.e., a low-pressure dome type hermetic compressor (1) in which a suction passage (not shown) of a compression mechanism (20) is communicated with the inner space of a sealed housing (10) and a discharge passage (41) of the compression mechanism (20) is connected to a discharge pipe (14). Below, this embodiment will be described only about different points from the above embodiment while the same parts are identified by the same reference numerals.

In this embodiment, the suction passage and the discharge passage (41) are disposed in an opposite side of the cylinder (23) to those in the above embodiment. The discharge passage (41) passes through the front head (54). The downstream end opening of the discharge passage (41) adjoins a discharge space (82) defined by the top surface of the front head (54) and the upper muffler (59). The discharge space (82) is communicated with a connecting passage (83), which downwardly passes through the front head (54) and extends in the cylinder (23). The downstream end of the connecting passage (83) is open at the outside surface of the cylinder (23) and the opening at the downstream end thereof is connected to the upstream end of the discharge pipe (14).

The discharge pipe (14) extends from its upstream end downward along one side of the compression mechanism (20), extends radially past below the compression mechanism (20) to the opposite side thereof and then extends upward along the inner periphery of the barrel (11). The upper part of the discharge pipe (14) is formed spirally so that vibrations of the compression mechanism (20) and electric motor (30) in operation can be absorbed. The downstream end part of the discharge pipe (14), i.e., the upper end part thereof, extends out through the center of the upper end plate (12) and is fixed to the upper end plate (12).

The discharge pipe (14) is provided with a branch pipe (85). The branch pipe (85) allows the discharge gas pressure to act on part of the outside surface of the cylinder (23) located opposite to part thereof where the connecting passage (83) is formed, so that the pressure of discharge gas discharged into the discharge pipe (14) cancels the force acting on the compression mechanism (20). Thus, the branch pipe (85) constitutes a differential pressure force canceling mechanism (52) in the present invention. Since in this embodiment the discharge passage (41) is not open at the bottom surface of the cylinder (23) and therefore no lower muffler is provided, the bottom surface of the rear head (55) of the compression mechanism (20) is resiliently supported to the lower end plate (13) via the mounting mechanisms (63).

In this embodiment, during operation of the compressor (1), the suction gas pressure in the sealed housing (10) acts uniformly on the entire compression mechanism (20) and the entire electric motor (30). Further, since the discharge pipe (14) is connected to the connecting passage (83) of the cylinder (23) of the compression mechanism (20) so that discharge gas is discharged into the discharge pipe (14), the pressure of discharge gas acts on the cylinder (23). Furthermore, the branch pipe (85) constituting the differential pressure force canceling mechanism (52) allows the pressure of discharge gas in the discharge pipe (14) to act on the part of the cylinder (23) opposite to the part thereof at which the discharge pipe (14) is connected to the cylinder (23).

To sum up, while the pressure of suction gas in the sealed housing (10) acts on the entire compression mechanism (20), pressures of discharge gas in opposite directions act on the part of the cylinder (23) of the compression mechanism (20) where the discharge pipe (14) is connected and the opposite part of the cylinder (23). Thus, all the forces acting on the compression mechanism (20) owing to the suction gas pressure and discharge gas pressure on the compression mechanism (20) are cancelled, which reduces the force acting on the compression mechanism (20).

As a result, like the above embodiment, the noise of the compressor (1) can be reduced well and the compressor (1) can be downsized. Further, since the discharge gas pressure acts directly on the cylinder (23) to which the discharge pipe (14) is connected, the position shift of the compression mechanism (20) and electric motor (30) can be restrained with ease and stability.

Figure 6:
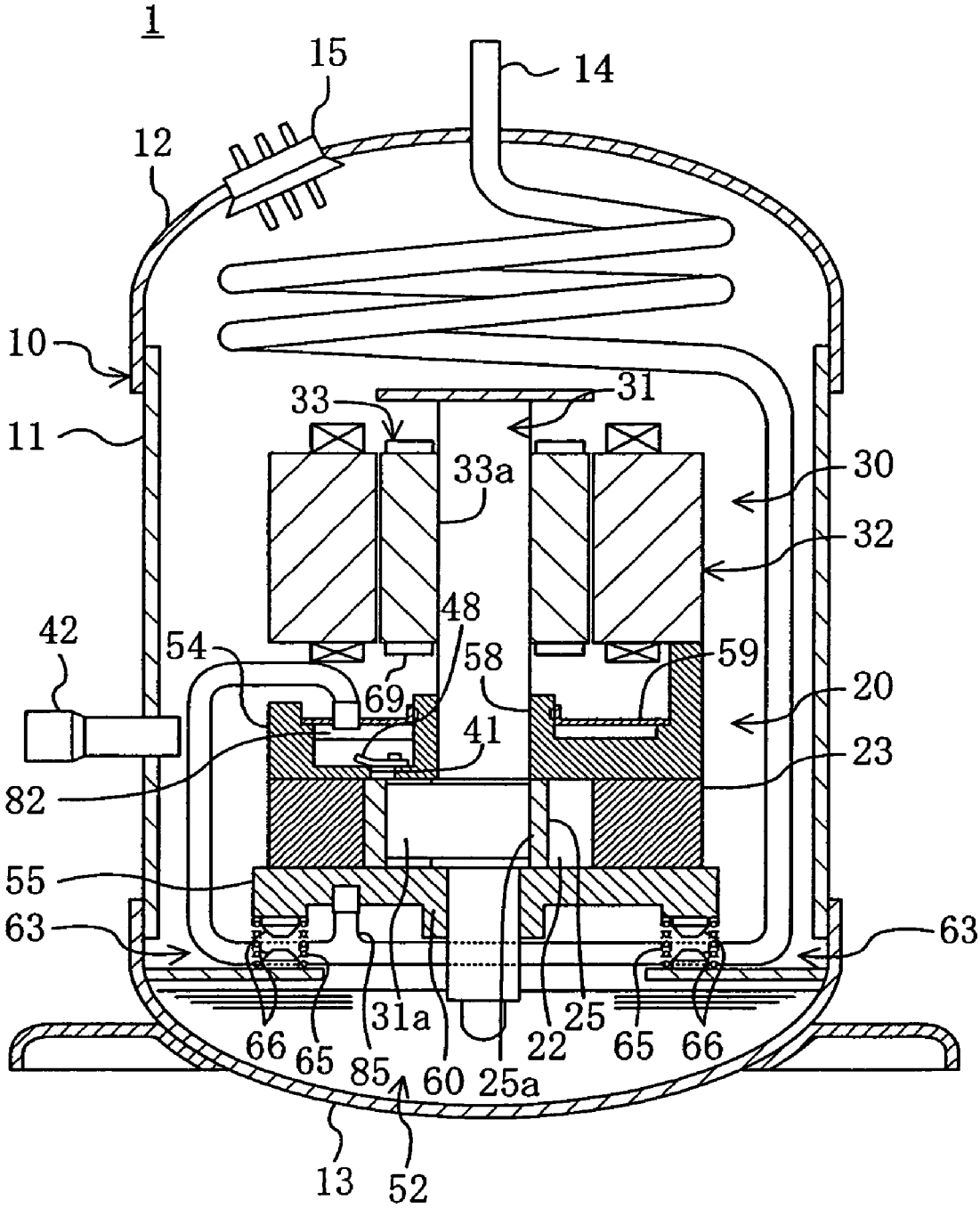
FIG. 6 is a corresponding view of FIG. 1 according to a variant of said another embodiment.

In this embodiment, as a variant shown in FIG. 6, the discharge pipe (14) may be placed so that its upstream end part penetrates the upper muffler (59) and the discharge pipe (14) may be communicated with the discharge passage (41) via the discharge space (82). In this case, a branch pipe (85) branched from the discharge pipe (14) allows the discharge gas pressure to act on part of the bottom surface of the rear head (55) located below part of the compression mechanism (20) located just below the discharge pipe (14), so that the discharge gas cancels the force acting on the compression mechanism (20).

Also in this variant, since the force acting on the compression mechanism (20) is reduced by the difference between the discharge gas pressure and the suction gas pressure, this reduces the noise of the compressor (1) well and downsizes the compressor (1). Further, the differential pressure force canceling mechanism (52) allows the discharge gas pressure to act on the rear head (55) opposed to the front head (54) formed with the discharge passage (41). In this case, the force due to discharge gas discharged into the discharge pipe (14) and the force due to the differential pressure force canceling mechanism (52) act on the compression mechanism (20) in vertically opposite directions. Therefore, the position shift of the compression mechanism (20) and electric motor (30) can be restrained with ease and stability.

The above embodiments are described for the case where the present invention is applied to a rocking piston type rotary compressor (1) in which the piston (25) is formed integrally with the blade (25*b*) so that the piston (25) can rock in the cylinder (23). The compressor to which the present invention is applicable is not limited to the above type. For example, the present invention is applicable to a rolling piston type rotary compressor in which a piston is provided separately from a blade and the distal end of the blade is pressed against the outer periphery of the piston.

INDUSTRIAL APPLICABILITY

As seen from the above, the hermetic compressor according to the present invention is useful when a compression mechanism and an electric motor are contained in a sealed housing and particularly suitable when the compression mechanism and the electric motor are resiliently supported in the sealed housing.

The invention claimed is:

1. A hermetic compressor comprising:

a sealed housing connected to a suction pipe that leads a suction gas into the sealed housing and a discharge pipe that leads a discharge gas out of the sealed housing;

a compression mechanism disposed in the sealed housing, and including a compression chamber, a suction passage connected to the suction pipe and open to the compression chamber, and a discharge passage fluidly connected to an inner space of the sealed housing, and open to the compression chamber;

an electric motor disposed in the sealed housing to rotate about a rotation axis, the electric motor being operatively coupled to the compression mechanism;

a differential pressure force canceling mechanism configured to allow a pressure of the suction gas to act on the compression mechanism to reduce a pressing force from the discharge gas in the sealed housing that acts on the compression mechanism along an axis of the suction passage, the differential pressure force cancelling mechanism forming a space with pressure of the suction gas between the sealed housing and the compression mechanism; and a resilient member supporting the compression mechanism and the electric motor relative to the sealed housing along the rotation axis, an open end of the suction pipe having an end face that faces an external surface of the compression mechanism having an opening of the suction passage formed therein, with a sliding connection fluidly connecting the open end of the suction pipe and the opening of the suction passage such that an area between the open end of the suction pipe and the opening of the suction passage is sealed and such that the opening of the suction passageway is movable along the rotation axis relative to the open end of the suction pipe.

2. The hermetic compressor of claim 1, wherein the compression mechanism is formed of a rotary fluid machine having a cylinder and a piston, the compression chamber is defined between an inner periphery of the cylinder and an outer periphery of the piston, the suction passage is formed to pass through the cylinder in a radial direction of the cylinder, and the differential pressure force canceling mechanism is configured to allow the pressure of the suction gas to act on an outside surface of the cylinder.

3. The hermetic compressor of claim 2, wherein the differential pressure force canceling mechanism is configured to allow the pressure of the suction gas to act on a portion of the outside surface of the cylinder opposite the suction passage.

4. The hermetic compressor of claim 2, wherein the differential pressure force canceling mechanism has a suction pressure chamber defined between an inner surface of the sealed housing and the outside surface of the cylinder and a communicating passage that fluidly connects the suction pressure chamber with the suction passage, the communicating passage is configured to allow a gas pressure in the suction pressure chamber to act on the cylinder.

5. The hermetic compressor of claim 4, wherein the communicating passage of the differential pressure force canceling mechanism is formed in the cylinder.

6. The hermetic compressor of claim 4, wherein the communicating passage of the differential pressure force canceling mechanism is formed in a substantially arcuate shape that extends along the inner periphery of the cylinder.

7. The hermetic compressor of claim 4, wherein the sealed housing connected to a plurality of suction pipes, and one of the suction pipes is connected to the suction passage of the compression mechanism while the other is connected to the suction pressure chamber of the differential pressure force canceling mechanism.

8. The hermetic compressor of claim 1, wherein the sealed housing has an opening with block member mounted therein, and the space with pressure of the suction gas is formed between the block member and the compression mechanism.

9. The hermetic compressor of claim 8, wherein the block member is solid in order to block the hole in the sealed housing from fluid communication therethrough.

10. The hermetic compressor of claim 8, wherein the block member has a through hole configured to receive an additional suction pipe.

* * * * *